United States Patent [19]

Rasmussen et al.

[11] 4,369,422

[45] Jan. 18, 1983

[54] MULTIPLE ELEMENT CURRENT LIMITING FUSE

[75] Inventors: John F. Rasmussen; Jayant S. Hemmady, both of Ballwin, Mo.

[73] Assignee: McGraw-Edison Company, Rolling Meadows, Ill.

[21] Appl. No.: 250,063

[22] Filed: Apr. 1, 1981

[51] Int. Cl.[3] ..... H01H 85/14

[52] U.S. Cl. ..... 337/248; 337/252

[58] Field of Search ..... 337/227, 228, 229, 231, 337/237, 246, 248, 251, 252, 247

[56] References Cited

U.S. PATENT DOCUMENTS

| | | | |
|---|---|---|---|
| 1,857,581 | 5/1932 | Athey | 337/230 |
| 2,180,874 | 11/1939 | Hunter et al. | 337/229 |
| 2,672,540 | 3/1954 | Dewey | 337/293 |
| 2,713,098 | 7/1955 | Swain | 337/246 X |
| 3,156,801 | 11/1964 | Cole et al. | 337/161 |
| 3,291,940 | 12/1966 | Kozacka et al. | 337/161 |
| 3,342,962 | 9/1967 | Kozacka | 337/247 |

*Primary Examiner*—George Harris

*Attorney, Agent, or Firm*—Charles W. MacKinnon; Ronald J. LaPorte; Jon C. Gealow

[57] ABSTRACT

A multiple element fuse has a pair of end bells with terminals for connection to spaced apart busbars of an external electrical circuit. A plurality of tube fuses are mechanically fastened and soldered at opposite ends thereof to the end bells. The tube fuses have insulative tubular bodies with metallic ferrules attached at each end. The ferrules which are received in cavities defined in the end bells, include hollow studs for receipt in countersunk holes also formed in the end bells. The studs are flared and/or receive expansion plugs to mechanically attach the tube fuses to the end bells, thereby to preserve the spacing between the end bells even when the fuse is subjected to tensile forces created by the busbars and sufficient heat to melt the solder during fuse clearing.

7 Claims, 5 Drawing Figures

MULTIPLE ELEMENT CURRENT LIMITING FUSE

BACKGROUND OF THE INVENTION

1. Field of the Invention

This invention relates to a multiple element fuse and in particular a multiple element fuse of open construction wherein each fusible element is mounted within an insulative tube.

2. Description of the Prior Art

Prior art multiple element fuses often include a plurality of fusible elements each mounted within an insulative tube. Fusible elements mounted in this fashion are commonly referred to as "tube fuses". Such multiple element fuses conventionally have end bells soldered at opposite ends to the tube fuses, the tube fuses being exposed therebetween. Devices of this type are designed to operate near their current carrying capacity and require an open construction to allow greater air cooling of the individual tube fuses. It is frequently desirable to provide air flow through the interior of the fuse, or to otherwise provide a forced cooling of the tube fuses.

A blade terminal typically is formed with or joined to the end bells of the multiple element fuses for connection with bolts or similar fasteners to elongated busbars of electrical equipment. Frequently, the busbars are not spaced apart to the exact distance required or have mounting holes otherwise misaligned with the mounting holes located in the blade terminals of the multiple element fuses. As such, one or both of the busbars must be deflected to provide alignment with the blade terminals, to allow a bolted connection to be made therebetween. This frequently imposes tensile and cantilever forces on the multiple element fuse end bells. As such, when the fuse operates to clear an electrical overload, the soldered connection between the end bells and the tube fuses sometimes softens or melts sufficiently to allow the busbars to resume their rest position, thus pulling the fuse apart, causing the individual tube fuses to fall away, possibly into the switch gear within which the fuse is installed.

In order to avoid the damage potential of fuse parts falling into the switch gear, fuses could be constructed with fusible elements which stay relatively cool during normal and clearing operations. However, this severely limits the ability of the tube fuses to operate near their current carrying capacity and thus greatly increases clearing $I^2t$.

SUMMARY OF THE INVENTION

Accordingly, it is an object of the present invention to provide a new and improved multiple element fuse comprising a plurality of tube fuses joined at the ends thereof to end bells designed for connection to spaced busbars, which fuse remains mechanically intact subsequent to the operation of the fuse to clear an electrical overload despite the application of tensile or cantilever forces to the end bells thereof.

It is another object of this invention to provide a multiple element fuse of the above-described type which has improved clearing $I^2t$ and yet is relatively inexpensive to fabricate, simple in design and effective in use.

The foregoing objects are accomplished in accordance with the present invention, in one form thereof, by providing a multiple element fuse comprising spaced apart end bells having blade-like terminals for connection to busbars of an external electrical circuit. A plurality of tube fuses are mechanically fastened and soldered at opposite ends within cavities or bores defined in the metallic end bells thereby to provide mechanical and electrical connection between the fuses and end bells. The tube fuses have insulative tubular bodies usually of ceramic or other high dielectric strength material, and metallic ferrules attached at each end. The ferrules include hollow studs or other mounting means for receipt in countersunk holes formed in the end bells. The studs are used to mechanically attach the tube fuses to the end bells by flare forming the hollow studs and/or by use of expansion plugs, rivets, bolts or the like or by both such means. The tube fuses thereby preserve the spacing between the end bells even when the fuse is subjected to tensile forces.

DETAILED DESCRIPTION OF THE PREFERRED EMBODIMENT

Figure 1:
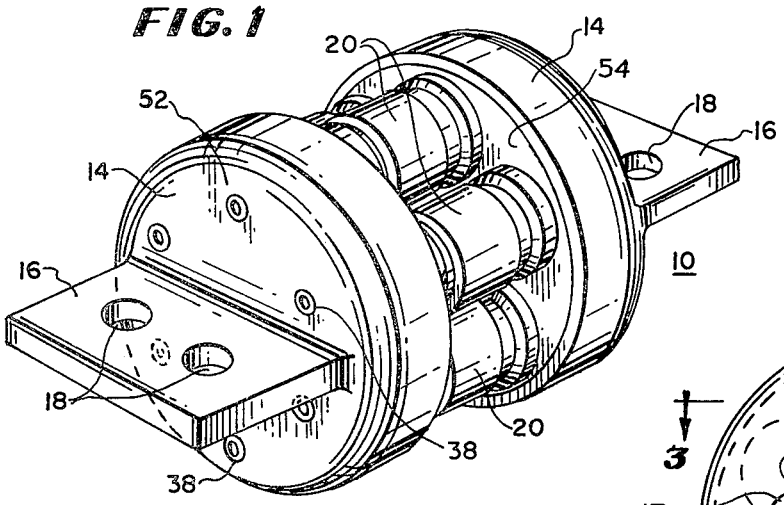
FIG. 1 is a perspective view of an assembled multiple element fuse including tube fuses according to the invention.
Figure 2:
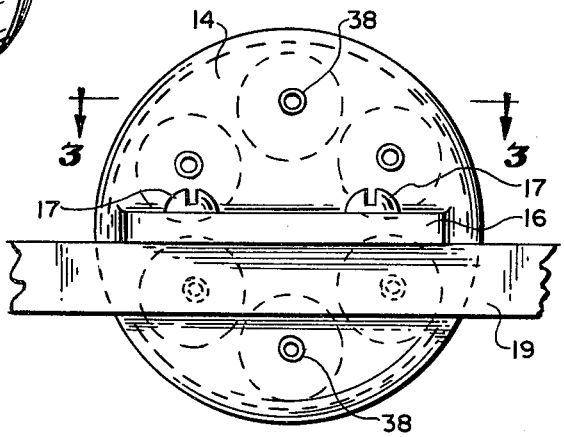
FIG. 2 is an end view of the multiple element fuse of FIG. 1, the fuse being shown installed between a pair of busbars.
Figure 3:
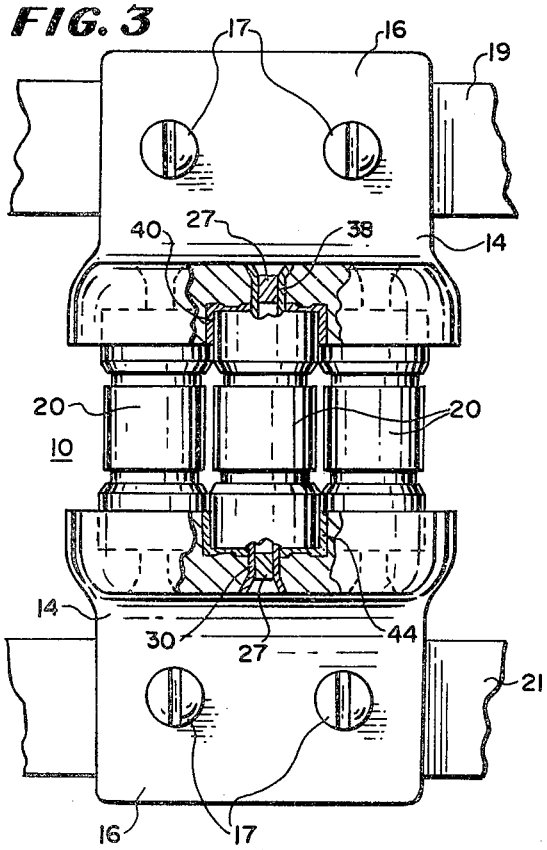
FIG. 3 is a side sectional view of the multiple element fuse of FIG. 2 taken along line 3—3 thereof.

Referring now to the drawing in greater detail wherein like numerals have been employed throughout the various views to designate similar components, FIGS. 1–3 illustrate a multiple element fuse 10 according to the invention. Multiple element fuse 10 comprises a pair of disc shaped metallic end bells 14 and a plurality of current carrying fusible elements, herein illustrated as cylindrically shaped tube fuses, each designated by the numeral 20.

The attachment of tube fuses 20 to end bells 14 according to the invention, maintains the multiple element fuse 10 intact under virtually all conditions. As will be described in greater detail hereinafter, the tube fuses 20 remain joined to end bells 14 even after high temperature clearing of the tube fuses 20, thereby preserving the spacing between the end bells despite forces applied thereto by busbars 19, 21 to which the fuse is coupled. Metallic end bells 14 are each provided with a blade-like terminal 16 for connection to the spaced apart electrical busbars, such as, for example, by bolts or the like fasteners 17 which are inserted into mounting holes 18 of terminals 16 and into aligned holes (not shown) in busbars 19, 21 in a conventional manner (see FIG. 3).

Figure 4:
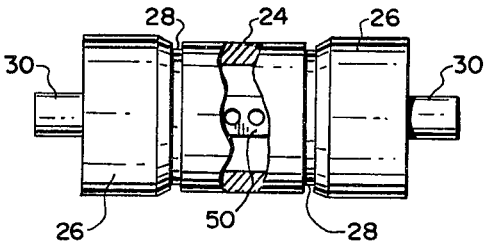
FIG. 4 is an enlarged side view of a tube fuse included in the multiple element fuse of FIG. 1.
Figure 5:
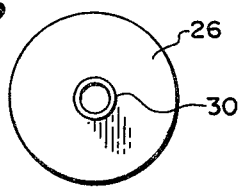
FIG. 5 is an end view of the tube fuse of FIG. 4.

A tube fuse 20 is shown in detail in FIGS. 4–5 of the drawing. A completely assembled tube fuse 20 illustrated in FIG. 4 encloses a fusible link 50 within a tubular body 24 of procelain or other suitable insulating material and metallic ferrules 26 provided at opposite ends thereof. Ferrules 26 are telescoped over each end of body 24, and are crimped for engagement of body 24 in circumferential grooves 28 defined therein thereby to form a rigid tube fuse assembly. Ferrules 26 have hollow studs 30 extending therefrom for receipt in holes 38 formed in exterior end surfaces 52 of end bells 14. Once received in holes 38, the studs are flared to mechanically couple the tube fuses and end bells. Rivets, bolts, expansion plugs, or similar means 27 (FIG. 3) may also be inserted into studs 30 of ferrules 26 to aid in mechanically coupling the tube fuses 20 to the end bells.

Multiple element fuse 10 shown in FIGS. 1–3 is constructed by placing solder 40 within a solder paste, into cavities 44 (FIG. 3) defined in interior surfaces 54 of end bells 14. Thereafter, the ends of a plurality of tube fuses 20 are placed into respective cavities 44, with hollow studs 30 being received in countersunk holes 38 in the end bells. Hollow studs 30 are secured thereto flaring in a conventional manner to form fit countersunk holes 38 or by bolts, rivets or the like means or commonly by both such means. Solder 40 within cavities 44 is melted by heating end bells 14 and thereafter allowing them to cool thereby to provide a further improved electrical and mechanical connection of the tube fuses 20 to end bells 14.

As described heretofore, multiple element fuse 10 illustrated in the drawing includes disc shaped end bells 14 having diameters of a predetermined length. Tube fuses 20, which are cylindrical in shape, are closely spaced near the periphery of end bells 14 such that terminals 16 do not interfere with holes 38 or studs 30 which penetrate the end bells.

As discussed above, multiple element fuses of the type described herein are typically operated at or near their rated capacity, and require an open construction wherein an outer casing between the end bells is omitted, thereby to provide enhanced cooling for the plurality of tube fuses included therein. Blade terminals 16 of the multiple element fuse provide the large contact area necessary for electrically connecting high capacity fuses of this type into an electrical circuit. As described, the blade terminals are typically bolted to busbars located in switch gear or other similar electrical devices. Any minor adjustments to the spacing between the busbars is usually made by bending them to provide alignment with mounting holes 18 of terminal 16, to allow passage of the bolts 17 or other fastening means therethrough. If the busbars are spaced too closely together, a compressive force is applied to the end bells 14 after fuse 10 is installed. In this case no unusual problems should occur upon fuse clearing. On the other hand if the busbars are spaced too far apart or if mounting holes in the busbars are improperly aligned and the busbars must be urged together or moved axially to allow installation of fuse 10, tensile or cantilever forces are applied to end bells 14 upon release of the busbars. In the latter case, upon fuse clearing, sufficient heat may be generated to weaken or melt solder 40, breaking the mechanical connection of tube fuses 20 with the end bells 14. Since no outer casing is present to maintain fuse 10 intact, tube fuses 20 would normally be free to drop out, often into the switch gear or other electrical devices in the vicinity, possibly causing damage thereto.

Tube fuses 20 including studs 30 employed in the multiple element fuse of the present invention, provide an efficient and effective means for holding end bells 14 together, thereby to maintain the tube fuses in place within fuse 10 even if internal solder connections between the end bells and tube fuses should weaken sufficiently to break.

A further advantage of the multiple element fuse construction according to the invention is enhanced high temperature performance. In the case of fuse 10, operating fuse temperatures can be made to exceed the highest solder melting temperatures without the fuse mechanically breaking apart. This permits greater latitude in fuse element design particularly with the use of high temperature designs which have lower clearing $I^2t$.

Thus, it can be seen that the multiple element fuse including tube fuses with studs according to the invention remains intact even in the event that tensile and cantilever forces are applied thereto, in the presence of an elevated temperature. Furthermore, the construction of the multiple element fuse of this invention provides enhanced high temperature performance, thereby to allow improved clearing $I^2t$.

While a particular embodiment of the invention has been shown and described, it should be understood that many modifications may be made therein and still fall within the scope of the invention. While in the preferred embodiment of multiple element fuse 10, all of the tube fuses 20 situated about the periphery of the end bells include hollow stud fasteners, it is possible to maintain end bells 14 intact under most conditions through the use of as few as one tube fuse equipped with hollow stud fasteners. Two such tube fuses spaced 180° about the end bells is however, preferable. Furthermore, a tube fuse having no hollow stud fastener but only soldered in place, may be located centrally of the other fuses to provide additional current carrying capacity in the multiple element fuse. It is therefore contemplated that the invention cover the aforementioned modifications and others which fall within the true spirit and scope of the appended claims.

We claim:

1. A multiple element, current-limiting fuse comprising:

First and second metallic end bells each having an interior surface, an exterior surface, and means for connection to an external electrical circuit; and a plurality of fusible elements disposed between said end bells, said fusible elements including a central body formed of electrically insulative material, said body having first and second ends, first and second metallic ferrules coupled to said first and second ends of said central insulative body, respectively, and a fusible link electrically connecting said first and second metallic ferrules;

one of said fusible elements being a securing fusible element, said securing fusible element having first stud means extending from said first metallic ferrule thereof for mechanically coupling said first metallic ferrule to said first metallic end bell and second stud means extending from said second metallic ferrule said second metallic end bell, said securing fusible element thereby maintaining said end bells in fixed spaced-apart relationship even upon the application of opposing forces to said end bells, said end bells define apertures therethrough, dimensioned for receipt of said stud means, and wherein said apertures include countersunk portions in said exterior surface of said end bells and said stud means are flared within said countersunk portions.

2. The fuse as claimed in claim 1 wherein said stud means include a hollow portion, said hollow portion being dimensioned for receipt of plug means, said plug means expanding said stud means upon insertion into said hollow portion, thereby urging said stud means into frictional engagement with said end bells.

3. The fuse as claimed in claim 2 wherein said apertures include countersunk portions in said exterior surface of said end bells and said stud means are flared within said countersunk portions.

4. The fuse as claimed in claim 1 wherein said fuse includes at least two of said securing fusible elements fastening said end bells in fixed spaced-apart relationship.

5. The fuse as claimed in claim 4 wherein said end bells are circular, and said fusible elements are cylindrically shaped and said two securing fusible elements are spaced substantially 180 degrees about the periphery of said end bells.

6. Said fuse as claimed in claim 1 wherein said end bells define cavities within said interior surfaces thereof, said ferrules of said fusible elements being received in said cavities, and wherein a heat softenable alloy is disposed within said cavities between said end bells and said ferrules of said fusible elements for mechanical and electrical connection therebetween.

7. The fuse as claimed in claim 1 wherein said insulative body of said fusible elements is formed of a ceramic material and defines grooves therein for crimp connection to said metallic ferrules of said body.

* * * * *